United States Patent [19]

Stahlecker

[11] 4,144,707

[45] Mar. 20, 1979

[54] OPEN END SPINNING ASSEMBLY WITH AN OPENER ROLL

[75] Inventor: Fritz Stahlecker, Josef-Neidhart-Str. 18, 7341 Bad Uberkingen, Fed. Rep. of Germany

[73] Assignees: Fritz Stahlecker; Hans Stahlecker, both of Fed. Rep. of Germany

[21] Appl. No.: 823,200

[22] Filed: Aug. 9, 1977

[30] Foreign Application Priority Data

Sep. 7, 1976 [DE] Fed. Rep. of Germany ..... 2640176

[51] Int. Cl.[2] ..... D01H 1/12

[52] U.S. Cl. ..... 57/58.91; 57/58.95

[58] Field of Search ..... 57/58.89, 58.95, 132; 308/155, 175, 176, DIG. 11

[56] References Cited

U.S. PATENT DOCUMENTS

| | | | |
|---|---|---|---|
| 2,620,240 | 12/1952 | Currence et al. | 308/155 |
| 3,750,380 | 8/1973 | Mladek et al. | 57/58.95 |
| 3,834,148 | 9/1974 | Sakurai et al. | 57/58.95 |
| 3,910,023 | 10/1975 | Müller | 57/58.91 X |

FOREIGN PATENT DOCUMENTS

| | | | |
|---|---|---|---|
| 2134867 | 1/1973 | Fed. Rep. of Germany | 57/58.91 |
| 1104149 | 11/1955 | France | 308/DIG. 11 |

*Primary Examiner*—Donald Watkins

*Attorney, Agent, or Firm*—Craig & Antonelli

[57] ABSTRACT

An assembly is provided for detachably supporting an opener roll and supporting opener roll shaft at an open end spinning unit. The assembly includes a housing defining a cylindrical receptacle, a bearing sleeve attached to the opener roll shaft to be movable therewith as a unit, and being selectively lockable in the receptacle. To accommodate locking of the bearing sleeve in the cylindrical receptacle, a pressure piece which is movable radially into a recess in the receptacle to engage against the bearing sleeve is provided, along with an adjustable locking mechanism connected to the pressure piece for accommodating movement thereof between the respective locking and unlocking positions. In preferred embodiments, the locking mechanism includes a lever portion in the area adjacent the opener roll, which area is exposed when the opener roll is exposed, so that the locking mechanism can be easily released and the opener roll can be then easily removed along with the bearing sleeve from the receptacle.

22 Claims, 4 Drawing Figures

OPEN END SPINNING ASSEMBLY WITH AN OPENER ROLL

BACKGROUND AND SUMMARY OF THE INVENTION

The invention concerns an open end spinning assembly with an opener roll, of the type having an opener roll shaft which is made as a structural unit with a bearing sleeve that is held detachably in a cylindrical receptacle in a housing.

In practical spinning operations it is advantageous if the opener rolls can readily be put into or removed from an open end spinning assembly, because damage can occur to them or their bearings which must not lead to long stoppages of the spinning assembly in question, or even of the whole spinning frame. For this reason it is customary to make opener rolls as a structural unit with a bearing sleeve that is releasably fixed in a bearing housing. In a known construction (German AS No. 2,234,422) it is provided that the bearing sleeves are tensioned in a housing with clamping means. Actuating elements are provided for the clamping means, actuatable from the side of the housing that presents the work chamber for the spinning rotor. The fastening means tension the bearing sleeves against slit housing parts, or against the housing walls. In this construction there is the danger that there will not be sufficient care in exchanging the opening rolls with their bearing sleeves, so that the sleeve itself will be tensioned and this will lead to extra loading of the bearing, hence to short life expectancy.

It is also known (German AS No. 2,145,655) to provide the bearing sleeves of textile machine spindles with a groove at the periphery, in which groove an elastic ring is laid. In this ring a pressure screw with a tip presses, serving for axial fixation of the bearing sleeve in the housing. This principle cannot be applied without modification to opener rolls of open end spinning assemblies because then there is the danger that the pressure screws will have to be disposed at a location where they are difficult to get at with a tool or the like.

The invention is addressed to the problem of producing an open end spinning assembly of the mentioned type in such a way that the opener roll can be easily put in and taken out, whereby care is to be taken that with any position of incorporation there will be no difficulty in the matter of accessibility, and also to exclude danger of damage to the opener roll bearing. This problem is solved in that the receptacle is provided with a recess into which a pressure piece extends, held adjustably with an adjusting mechanism, radially with reference to the bearing sleeve.

This arrangement allows axial fixation without tensioning of the bearing sleeve. The adjusting mechanism further makes it possible to apply the pressure piece at any location and to design the adjusting mechanism in such a way that it can be actuated from an easily accessible place.

These and other objects, features and advantages of the present invention will become more apparent from the following description when taken in connection with the accompanying drawings, which show, for purposes of illustration only, several embodiments in accordance with the present invention.

DETAILED DESCRIPTION OF THE DRAWINGS

Figure 1:
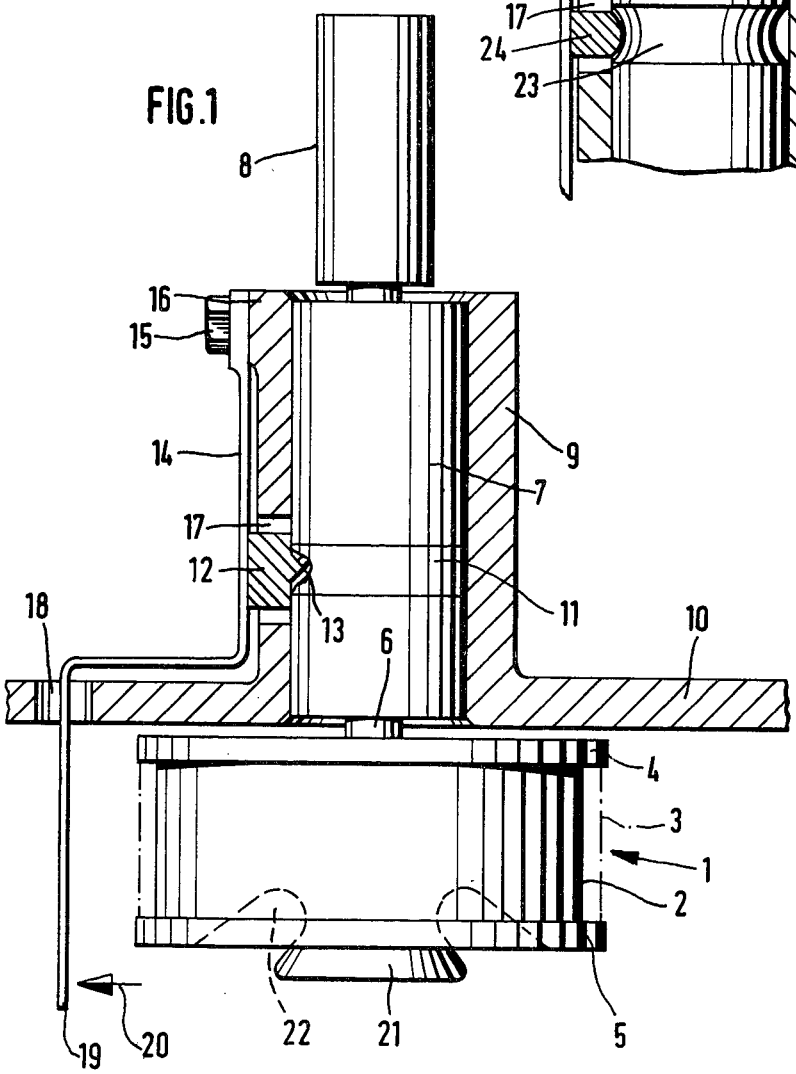
FIG. 1 is an axial sectional schematic view through an opener roll secured according to the invention, in an open end spinning assembly.

Opener roll 1 as in FIG. 1 presents a cylindrical base body limited with annular shoulders 4 and 5, on which a fitting 3 presenting needles or pins or sawteeth or the like is disposed, only schematically indicated in FIG. 1. Base body 2 is disposed on a shaft 6 borne with roller bearings in a way that is not shown in detail, in a bearing sleeve 7 that forms a structural unit with opener roll 1. The free end of shaft 6 extends beyond bearing sleeve 7 and is provided with a whorl 8, over which the opener roll is driven by means of a tangential belt or a single belt. Bearing sleeve 7 is thrust into a cylindrical receptacle 9 of a wall 10. Since other structural details of a spinning assembly, including an opener roll operably associated with other spinning machine structures is well known to those skilled in the art, the same is dispensed with herein in order not to obscure the present invention. For example, U.S. Pat. No. 3,987,610 discloses a spinning unit assembly, with an opener roll, which is of the general type contemplated for use in conjunction with the present invention.

In servicing an open end spinning frame it is advantageous if the opener roll 1 or its bearing can also be checked. For this it is advantageous if the opener roll is so disposed that after opening of the spinning assembly it can be exposed relatively simply. This means that the opener roll is located in a zone that is accessible from the front side of the open end spinning frame or spinning assembly (bottom of FIG. 1 illustration). This has the practical effect that, particularly if a drive is provided with a tangential belt running in the long direction of the machine, the bearing sleeve 7 and also whorl 8 must be disposed in a region that is not easily accessible from the front of the open end spinning assembly. Nevertheless, opener roll 1 must be relatively easily removed and replaced if so required.

To make this possible it is provided that bearing sleeve 7 is held with a relatively broad sliding seat in cylindrical receptacle 9 and secured by an extra axial securing device. For this, bearing sleeve 7 has an annular groove in which an elastic insert 11 is laid in, which presents about the same external diameter as sleeve 7. In receptacle 9, in the region of elastic insert 11, sleeve 7 has a recess 17 into which a pressure piece 12 penetrates, said piece having a tip 13. This pressure piece 12, whose tip 13 penetrates into elastic insert 11, effects the axial securing of the bearing sleeve 7. Pressure piece 12 which penetrates into recess 17 is held by a leaf spring 14, fixed at the greatest possible distance on receptacle 9 (extreme end of receptacle 9) which has a flange 16, by means of a screw 15. In this embodiment, leaf spring 14 is parallel to shaft 6 of the opener roll, so that the extra space requirement for the securing device including the leaf spring 14 is slight.

Leaf spring 14 is extended out over pressure piece 12 in such a way that its free end 19 extends into the region of opener roll 1, for which leaf spring 14 is bent in a Z for instance, and can be introduced through a hole 18 in wall part 10. Free end 19 then is in a region that otherwise has to be exposed to check opener roll 1, and there it is readily accessible. The free end 19 serves as an actuating lever which, when it is swung in the direction of arrow 20, releases pressure piece 12 from insert piece 11 so that the opener roll can then be easily extracted from receptacle 9.

To facilitate engagement of opener roll 1, the side turned toward shaft 6 has a troughlike depression 22 which results in a button like part 21, from the front of opener roll 1. This button like element has a somewhat conical configuration as shown.

Figure 2:
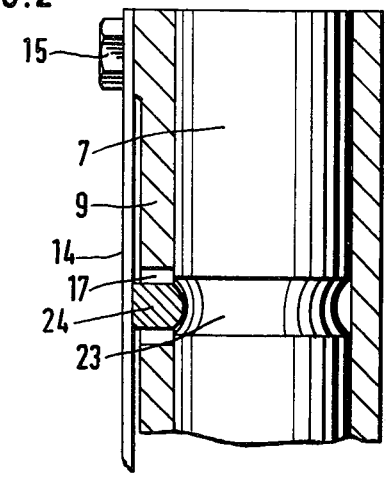
FIG. 2 is a partial sectional schematic view through another embodiment of the present invention which is similar to that of FIG. 1.

In the embodiment according to FIG. 2, bearing sleeve 7 has a shaped channel 23 in which a correspondingly shaped pressure piece 24, preferably plastic, penetrates. This shaped pressure piece 24 is borne in a way that is similar to pressure piece 12 of FIG. 1, by a leaf spring 14. In this embodiment a precise axial securing of bearing sleeve 7 and hence of the opener roll is attained by the pressure piece, whereas in the embodiment of FIG. 1, advantageously as in the case of the embodiment illustrated in FIG. 3 there is an annular flange 25 on bearing sleeve 7 which with a corresponding recess in receptacle 9 constitutes an axial stop.

Figure 3:
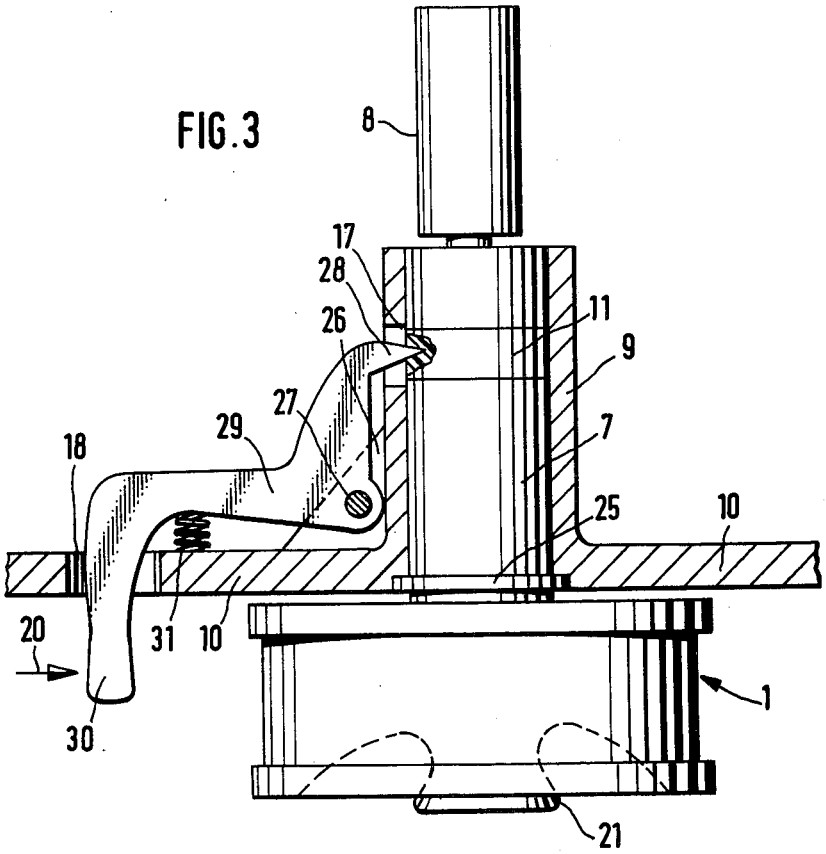
FIG. 3 is an axial sectional schematic view through yet another embodiment of the present invention.

In the embodiment according to FIG. 3 there is a more or less Z shaped lever 29 swingably borne by means of a pin 27 on wall part 10 or receptacle 9 so that a free end with a tip 28 can move more or less radially with reference to bearing sleeve 7. Tip 28 penetrates receptacle 9 in the region of opening 17 and is opposite an elastic insert 11 of the bearing sleeve. Lever 29 extends forward from wall part 10 through a hole 18 with its free end 30, in a way similar to leaf spring 14 of FIG. 1 so that it is disposed in the region of opener roll 1. Lever 29 is loaded by a pressure spring 31 which bears on wall part 10 and the lever. Pressure spring 31 presses the lever with its tip 28 into insert 11. To release tip 28 from insert 11, the lever must be engaged at its free end 30 and swung about pin 27. This can be effected for example by loading in the direction of arrow 20. The opener roll can then be pulled forward together with its bearing sleeve 7 from receptacle 9, i.e. to the side of opener roll 1.

Figure 4:
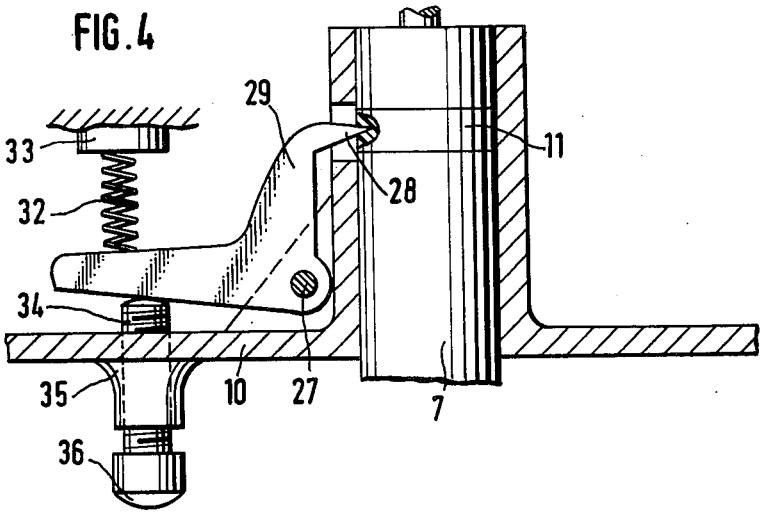
FIG. 4 is a partial sectional view through an embodiment similar in certain aspects to the embodiment of FIG. 3.

In the embodiment as in FIG. 4, which is generally similar to the FIG. 3 embodiment, it is provided that lever 29 will be loaded by a pressure screw 34 screwed into wall part 10, the head of which screw is accessible for a tool in the region of the opener roll. Pressure screw 34 which is screwed into a threaded insert 35 of wall part 10 presses lever 29 with its tip 28 into the elastic insert 11 of bearing sleeve 7. A compression spring 32 bearing on a fixed stop 33 acts against pressure screw 34. When pressure screw 34 is turned back, spring 32 has the effect that the tip 28 will be pulled out of elastic insert 11.

While we have shown and described only several embodiments in accordance with the present invention, it is understood that the same is not limited thereto but is susceptible of numerous changes and modifications as would be known to those skilled in the art, given the present disclosure, we therefore do not wish to be limited to the details shown and described herein but intend to cover all such changes and modifications as are encompassed by the scope of the appended claims.

I claim:

1. An assembly for detachably supporting an opener roll and opener roll shaft at an open end spinning unit or the like, comprising:

housing means defining a cylindrical receptacle, a cylindrical bearing sleeve for rotatably supporting an opener roll shaft and opener roll, said bearing sleeve being axially movable into and out of said receptacle along with said opener roll shaft and opener roll supported thereby, radially extending recess means in said receptacle, radially extending depression means in said bearing sleeve, a pressure piece movable radially in said recess means, and an adjustable locking mechanism for adjustably holding said pressure piece against said bearing sleeve in said depression means to lock said bearing sleeve in a predetermined axial position in said receptacle, wherein the shaft of the opener roll is disposed crosswise to the long direction of the spinning machine and is driven by a tangential belt that runs in the long direction of the machine, whereby the adjusting mechanism extends forward beyond the spinning assembly with its part which is actuable manually or by means of a tool, and is accessible after the opening of a cover or the like.

2. An assembly for detachably supporting an opener roll and opener roll shaft at an open end spinning unit or the like, comprising:

housing means defining a cylindrical receptacle, a bearing sleeve for rotatably supporting an opener roll shaft and opener roll, said bearing sleeve being axially movable into and out of said receptacle along with said opener roll shaft and opener roll supported thereby, radially extending recess means in said receptacle, a pressure piece movable radially in said recess means, and an adjustable locking mechanism for adjustably holding said pressure piece against said bearing sleeve to lock said bearing sleeve in a predetermined position in said receptacle, and wherein the bearing sleeve is provided with an elastic insert to receive the pressure piece, said pressure piece presenting a tip lockingly engageable in said elastic insert.

3. Assembly as in claim 1, wherein the depression means is a shaped recess to receive the correspondingly shaped pressure piece.

4. Assembly as in claim 2, characterized in that the adjusting mechanism includes a spring which loads the pressure piece in the direction toward the bearing sleeve.

5. Assembly as in claim 3, characterized in that the adjusting mechanism includes a spring which loads the pressure piece in the direction toward the bearing sleeve.

6. Assembly as in claim 4, wherein said spring is a leaf spring.

7. Assembly as in claim 2, characterized in that as adjusting mechanism there is a double arm lever, one arm of which lever is made as the pressure piece.

8. Assembly as in claim 3, characterized in that as adjusting mechanism there is a double arm lever, one arm of which lever is made as the pressure piece.

9. Assembly as in claim 7, wherein a set screw engages the double arm lever.

10. Assembly as in claim 2, wherein the bearing sleeve is provided with a stop for fixing its axial position.

11. Assembly as in claim 4, wherein the bearing sleeve is provided with a stop for fixing its axial position.

12. Assembly as in claim 7, wherein the bearing sleeve is provided with a stop for fixing its axial position.

13. Assembly as in claim 2, wherein the adjusting mechanism extends into a region that is accessible when the opener roll is exposed upon opening of the spinning unit opener roll housing.

14. Assembly as in claim 2, wherein the shaft of the opener roll is disposed crosswise to the long direction of the spinning machine and is driven by a tangential belt that runs in the long direction of the machine, whereby the adjusting mechanism extends forward beyond the spinning assembly with its part which is actuatable manually or by means of a tool, and is accessible after the opening of a cover or the like.

15. Assembly as in claim 4, wherein the shaft of the opener roll is disposed crosswise to the long direction of the spinning machine and is driven by a tangential belt that runs in the long direction of the machine, whereby the adjusting mechanism extends forward beyond the spinning assembly with its part which is actuatable manually or by means of a tool, and is accessible after the opening of a cover or the like.

16. Assembly as in claim 14, wherein the bearing sleeve is provided with a stop for fixing its axial position.

17. Assembly as in claim 2, wherein the opener roll is provided with a manual grip on its front side opposite its shaft.

18. Assembly as in claim 11, wherein a recess is worked into the face of the opener roll turned away from the shaft, which recess leaves a grip button which can be manually engaged to pull the opener roll sleeve bearing and shaft out of the spinning unit when said pressure piece is adjustably moved away from a position bearing radially against the bearing sleeve.

19. Assembly as in claim 4, wherein a recess is worked into the face of the opener roll turned away from the shaft which recess leaves a grip button which can be manually engaged to pull the opener roll sleeve bearing and shaft out of the spinning unit when said pressure piece is adjustably moved away from a position bearing radially against the bearing sleeve.

20. Assembly as in claim 7, wherein a recess is worked into the face of the opener roll turned away from the shaft which recess leaves a grip button which can be manually engaged to pull the opener roll sleeve bearing and shaft out of the spinning unit when said pressure piece is adjustably moved away from a position bearing radially against the bearing sleeve.

21. An assembly for detachably supporting an opener roll and opener roll shaft at an open end spinning unit or the like, comprising:

housing means defining a cylindrical receptacle, a bearing sleeve for rotatably supporting an opener roll shaft and opener roll, said bearing sleeve being axially movable into and out of said receptacle along with said opener roll shaft and opener roll supported thereby, radially extending recess means in said receptacle, a pressure piece movable radially in said recess means, and an adjustable locking mechanism for adjustably holding said pressure piece against said bearing sleeve in a predetermined position in said receptacle, characterized in that as adjusting mechanism there is a double arm lever, one arm of which lever is made as the pressure piece, wherein a set screw engages the double arm lever.

22. An assembly for detachably supporting an opener roll and opener roll shaft at an open end spinning unit or the like, comprising:

housing means defining a cylindrical receptacle, a bearing sleeve for rotatably supporting an opener roll shaft and opener roll, said bearing sleeve being axially movable into and out of said receptacle along with said opener roll shaft and opener roll supported thereby, radially extending recess means in said receptacle, a pressure piece movable radially in said recess means, and an adjustable locking mechanism for adjustably holding said pressure piece against said bearing sleeve to lock said bearing sleeve in a predetermined position in said receptacle, wherein a recess is worked into the face of the opener roll turned away from the shaft, which recess leaves a grip button which can be manually engaged to pull the opener roll sleeve bearing and shaft out of the spinning unit when said pressure piece is adjustably moved away from a position bearing radially against the bearing sleeve.

* * * * *